US007463222B2

(12) United States Patent
Fish et al.

(10) Patent No.: US 7,463,222 B2
(45) Date of Patent: Dec. 9, 2008

(54) DEVICES AND METHODS FOR ELECTROLUMINESCENT DISPLAY

(75) Inventors: David A. Fish, Haywards Heath (GB); Mark J. Childs, Sutton (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 652 days.

(21) Appl. No.: 10/526,195

(22) PCT Filed: Aug. 22, 2003

(86) PCT No.: PCT/IB03/03804

§ 371 (c)(1),
(2), (4) Date: Mar. 1, 2005

(87) PCT Pub. No.: WO2004/023444

PCT Pub. Date: Mar. 18, 2004

(65) Prior Publication Data

US 2005/0243031 A1 Nov. 3, 2005

(30) Foreign Application Priority Data

Sep. 5, 2002 (GB) ..... 0220614.2

(51) Int. Cl.
*G09G 3/30* (2006.01)

(52) U.S. Cl. ..... 345/76; 315/169.3

(58) Field of Classification Search ..... 345/76–80, 345/82, 207; 315/169.3
See application file for complete search history.

(56) References Cited

U.S. PATENT DOCUMENTS 5,952,789 A * 9/1999 Stewart et al. ..... 315/169.4
6,373,454 B1 4/2002 Knapp et al.
6,529,178 B1 * 3/2003 Kimura ..... 345/76

FOREIGN PATENT DOCUMENTS

| | | | |
|---|---|---|---|
| EP | 0717446 | A2 | 6/1996 |
| EP | 0717446 | A3 | 6/1999 |
| EP | 1096466 | A1 | 5/2001 |
| EP | 1170718 | A1 | 1/2002 |
| JP | 05035207 | A | 2/1993 |
| JP | 05035207 | B2 | 5/1993 |
| JP | 05035207 | U | 5/1993 |
| WO | WO9848403 | A1 | 10/1998 |
| WO | WO0120591 | A1 | 3/2001 |

OTHER PUBLICATIONS

David A. Fish; A Comparison of Pixel Circuits for Active Matrix Polymer/Organic LED Displays; SID 02 Digest, May 2002; pp. 968-971.

* cited by examiner

*Primary Examiner*—Richard Hjerpe
*Assistant Examiner*—Shaheda A Abdin
(74) *Attorney, Agent, or Firm*—Michael E. Belk

(57) ABSTRACT

In an active matrix electroluminescent display device, a storage capacitor (24) is provided for storing a voltage to be used for addressing a drive transistor (22). A discharge photodiode (27) is provided for discharging the storage capacitor in dependence on the light output of the display element, and an input data voltage applied to the pixel is changed by an amount corresponding to the threshold voltage of the drive transistor. The changed data voltage is applied between the gate and source of the drive transistor.In this device the initial voltage on the gate of the drive transistor is modified so as to remove the dependency of the light output on the threshold voltage, so that threshold voltage variations can be tolerated.

13 Claims, 4 Drawing Sheets

DEVICES AND METHODS FOR ELECTROLUMINESCENT DISPLAY

This invention relates to electroluminescent display devices, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer. The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100nm and 200nm. Typical examples of suitable organic electroluminescent materials which can be used for the elements 2 are known and described in EP-A-0 717446. Conjugated polymer materials as described in WO96/36959can also be used.

FIG. 2 shows in simplified schematic form a known pixel and drive circuitry arrangement for providing voltage-addressed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended.

The drive transistor 22 in this circuit is implemented as a PMOS TFT, so that the storage capacitor 24 holds the gate-source voltage fixed. This results in a fixed source-drain current through the transistor, which therefore provides the desired current source operation of the pixel.

In the above basic pixel circuit, different transistor characteristics across the substrate (particularly the threshold voltage) give rise to different relationships between the gate voltage and the source-drain current, and artefacts in the displayed image result. In addition to these threshold voltage variations, differential aging of the LED material gives rise to variations in image quality across a display.

It has been recognised that a current-addressed pixel (rather than a voltage-addressed pixel) can reduce or eliminate the effect of transistor variations across the substrate. For example, a current-addressed pixel can use a current mirror to sample the gate-source voltage on a sampling transistor through which the desired pixel drive current is driven. The sampled gate-source voltage is used to address the drive transistor. This partly mitigates the problem of uniformity of devices, as the sampling transistor and drive transistor are adjacent each other over the substrate and can be more accurately matched to each other. Another current sampling circuit uses the same transistor for the sampling and driving, so that no transistor matching is required, although additional transistors and address lines are required.

There have also been proposals for voltage-addressed pixel circuits which compensate for the aging of the LED material. For example, various pixel circuits have been proposed in which the pixels include a light sensing element. This element is responsive to the light output of the display element and acts to leak stored charge on the storage capacitor in response to the light output, so as to control the integrated light output of the display during the address period. FIG. 3 shows one example of pixel layout for this purpose. Examples of this type of pixel configuration are described in detail in WO 01/20591and EP 1 096 466.

In the pixel circuit of FIG. 3, a photodiode 27 discharges the gate voltage stored on the capacitor 24. The EL display element 2 will no longer emit when the gate voltage on the drive transistor 22 reaches the threshold voltage, and the storage capacitor 24 will then stop discharging. The rate at which charge is leaked from the photodiode 27 is a function of the display element output, so that the photodiode 27 functions as a light-sensitive feedback device. It can be shown that the integrated light output, taking into the account the effect of the photodiode 27, is given by:

$$L_T = \frac{C_S}{\eta_{PD}}(V(0) - V_T) \quad [1]$$

In this equation, $\eta_{PD}$ is the efficiency of the photodiode, which is very uniform across the display, $C_S$ is the storage capacitance, V(0) is the initial gate-source voltage of the drive transistor and $V_T$ is the threshold voltage of the drive transistor. The light output is therefore independent of the EL display element efficiency and thereby provides aging compensation. However, $V_T$ varies across the display so it will exhibit non-uniformity. Reference is made to the paper "A comparison of pixel circuits for Active Matrix Polymer/Organic LED Displays" by D. A. Fish et al., 32.1, SID 02Digest, May 2002.

There are refinements to this basic circuit, but the problem remains that practical voltage-addressed circuits are still susceptible to threshold voltage variations.

According to a first aspect of the invention, there is provided an active matrix electroluminescent display device comprising an array of display pixels, each pixel comprising:

an electroluminescent display element;

a drive transistor for driving a current through the display element;

a storage capacitor for storing a voltage to be used for addressing the drive transistor;

a discharge photodiode for discharging the storage capacitor in dependence on the light output of the display element; and circuit elements for changing an input data voltage applied to the pixel by an amount corresponding to the threshold voltage of the drive transistor, and for applying the changed data voltage between the gate and source of the drive transistor.

In this pixel arrangement, circuitry is provided for modifying the initial voltage on the gate of the drive transistor. With reference to equation [1] above, this has the effect of removing the dependency of the light output on the threshold voltage, so that threshold voltage variations can be tolerated.

As in the conventional circuits, each pixel comprises an address transistor connected between a data signal line and an input to the pixel, and the drive transistor is connected between a power supply line and the display element.

In a first embodiment, the storage capacitor is connected between the power supply line and the gate of the drive transistor. Thus, the storage capacitor stores the gate-source voltage of the drive transistor. In order to modify the pixel drive voltage, the circuit elements in this embodiment comprise a second photodiode and a second storage capacitor, wherein the second photodiode is connected between the gate of the drive transistor and one terminal of the second storage capacitor, and the discharge photodiode is connected between the one terminal and the power supply line.

In this arrangement, a second storage capacitor is used for charge pumping. At the end of a frame, the voltage on the gate of the drive transistor is the threshold voltage, because this is the voltage at which the transistor turns off. The circuit of this embodiment acts to add a drive voltage to the threshold voltage already stored on the first storage capacitor, through capacitive coupling, namely charge pumping. By ensuring the voltage on the storage capacitor is increased by a drive voltage, rather than charged to the drive voltage, the dependency on the threshold voltage is removed.

In this arrangement, the data input to the pixel is supplied to the second terminal of the second storage capacitor.

The LED should be turned off during the addressing phase, so that the photodiodes have minimum influence on the charge pumping operation. For this purpose, an isolating transistor is preferably connected between the drive transistor and the display element.

In a second embodiment, the storage capacitor is again connected between the power supply line and the gate of the drive transistor, and the photodiode is connected between the power supply line and the gate of the drive transistor. The circuit elements comprise two parallel oppositely facing diode-connected transistors, connected between the input to the pixel and the gate of the drive transistor. In this arrangement, a diode-connected transistor provides a voltage drop which equates to the threshold voltage (if the diode-connected transistor is matched to the drive transistor) between the voltage input to the pixel and the voltage stored on the storage capacitor. The voltage drop across the diode-connected transistor translates to an increased voltage across the storage capacitor (because it is connected to the power supply line) thereby removing the dependency of the light output on the threshold voltage.

In a third embodiment, the storage capacitor and the discharge photodiode are connected in parallel between the power supply line and an input to the pixel, and the circuit elements comprise a threshold storage capacitor connected between the input and the gate of the drive transistor.

In this arrangement, the storage capacitor does not store the desired source-gate voltage of the drive transistor. Instead, the storage capacitor stores the input drive voltage, and a series-connected threshold storage capacitor provides a voltage shift between the storage capacitor and the gate of the drive transistor. Additional circuitry is required to enable the threshold voltage to be stored on the threshold storage capacitor. For example, the circuit elements may further comprise a bypass transistor connected between the source and gate of the drive transistor for charging the threshold storage capacitor to the threshold voltage using a current of the drive transistor.

According to a second aspect of the invention, there is provided an active matrix electroluminescent display device comprising an array of display pixels, each pixel comprising:

an electroluminescent display element;

a current sampling circuit for sampling a drive current and including a drive transistor for driving current through the display element;

a storage capacitor for storing a gate-source voltage for the drive transistor corresponding to the sampled drive current; and a photodiode for discharging the storage capacitor in dependence on the light output of the display element.

In this arrangement, a current sampling circuit is used to sample a drive current. This enables threshold voltage variations to be avoided. The photodiode additionally enables aging compensation to be implemented.

In one embodiment of the second aspect of the invention, the current sampling circuit comprises an isolating transistor for selectively isolating the drive transistor from the display element and a bypass transistor for selectively connecting the drive transistor to the input of the pixel. This current sampling circuit uses the drive transistor for the current sampling. Other circuits are also possible which act as current mirrors, with separate current sampling and current drive transistors.

The first aspect of the invention also provides a method of driving an active matrix electroluminescent display device comprising an array of display pixels each comprising a drive transistor and an electroluminescent display element, the method comprising, for each addressing of the pixel:

applying a drive voltage to an input of the pixel;

modifying the drive voltage by an amount corresponding to the threshold voltage of the drive transistor;

storing the modified drive voltage in a capacitor arrangement and applying the modified drive voltage to the gate of the drive transistor, thereby compensating for threshold variations between drive transistors of different pixels; and discharging the capacitor arrangement using a photodiode illuminated by the light output of the electroluminescent display element, thereby compensating for aging variations between pixels.

This method provides the optical feedback discharge of the storage capacitor for aging compensation, in combination with threshold voltage compensation.

Storing the modified drive voltage can comprise:

storing the modified drive voltage on a capacitor;

storing the drive voltage on a first capacitor and storing a voltage corresponding to the threshold voltage of the drive transistor on a second capacitor; or pumping the drive voltage onto a storage capacitor on which a voltage corresponding to the threshold voltage was previously provided.

The second aspect of the invention also provides a method of driving an active matrix electroluminescent display device comprising an array of display pixels each comprising a drive transistor and an electroluminescent display element, the method comprising, for each addressing of the pixel:

applying a drive current to an input of the pixel;

sampling the drive current to obtain a gate-source voltage of the drive transistor corresponding to the drive current;

storing the gate-source voltage on a storage capacitor;

applying the gate-source voltage to the drive transistor; and discharging the storage capacitor using a photodiode illuminated by the light output of the electroluminescent display element.

This method uses current addressing to provide threshold compensation but additionally uses the optical feedback discharge of the storage capacitor for aging compensation.

The invention will now be described by way of example with reference to the accompanying drawings, in which.

Figure 1:
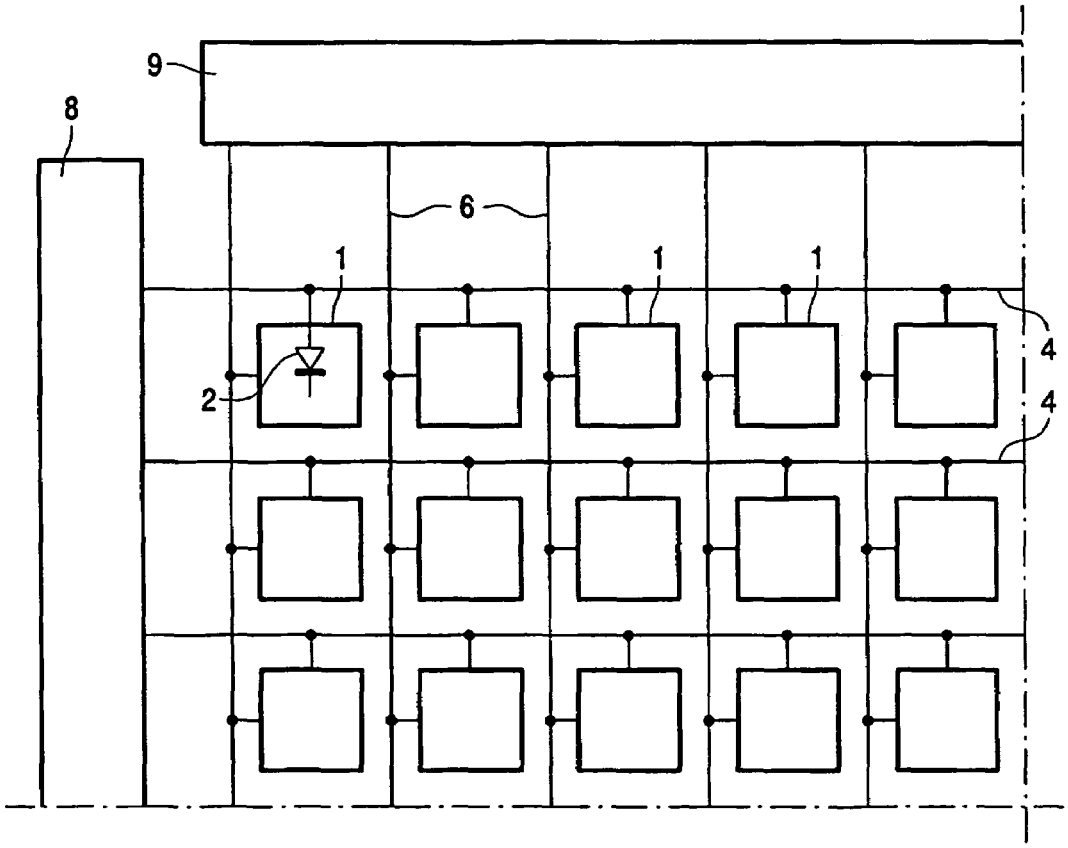
FIG.1 PRIOR ART
FIG. 1 shows a known EL display device.

It should be noted that these figures are diagrammatic and not drawn to scale. Relative dimensions and proportions of parts of these figures have been shown exaggerated or reduced in size, for the sake of clarity and convenience in the drawings.

In accordance with the invention, the pixel circuitry is modified so that an input data voltage applied to the pixel can be changed by an amount corresponding to the threshold voltage of the drive transistor. This is in addition to the use of a photodiode to removing aging fluctuations. This enables the initial voltage on the gate of the drive transistor to be modified, so that in equation [1] above, this has the effect of removing the dependency of the light output on the threshold voltage, so that threshold voltage variations can be tolerated.

Figure 2:
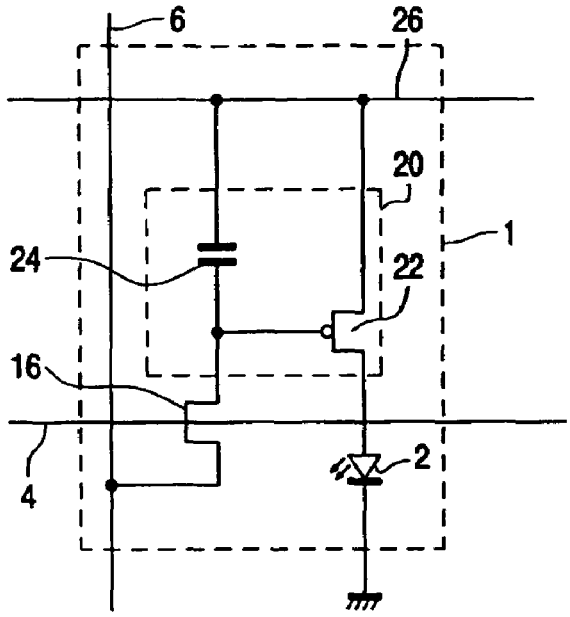
FIG.2 PRIOR ART
FIG. 2 is a simplified schematic diagram of a known pixel circuit for current-addressing the EL display pixel.
Figure 3:
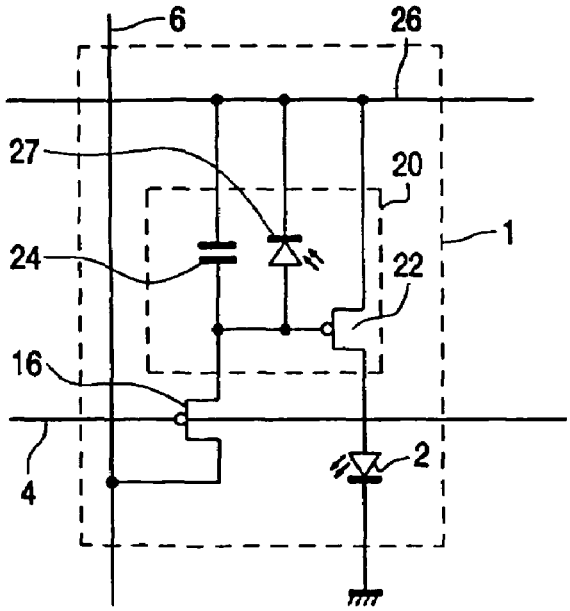
FIG. 3 shows a known pixel design which compensates for differential aging.
Figure 4:
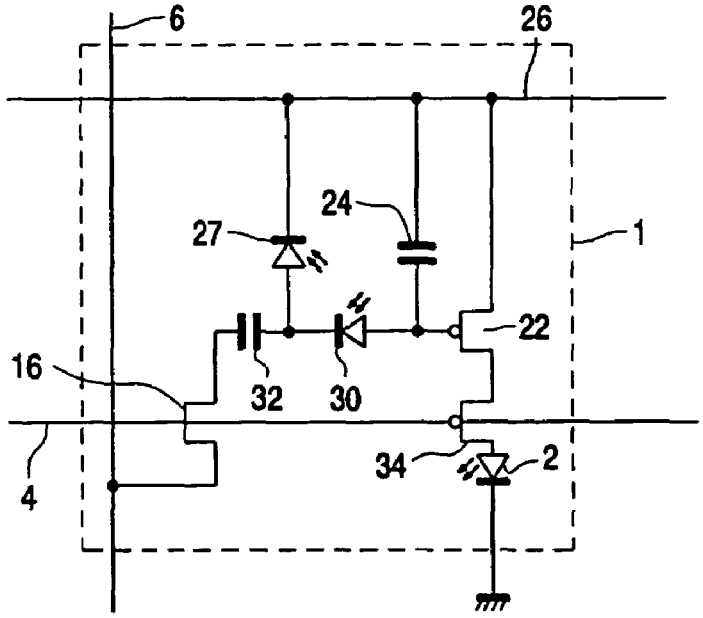
FIG. 4 shows a first example of pixel circuit according to the invention.

FIG. 4 shows a first example of pixel layout of the invention. The same reference numerals are used to denote the same components as in FIGS. 2 and 3, and the pixel circuit is for use in a display such as shown in FIG. 1.

The storage capacitor 24 is again connected between the power supply line 26 and the gate of the drive transistor 22. Thus, the storage capacitor stores the gate-source voltage of the drive transistor 22. In order to modify the pixel drive voltage, a second photodiode 30 and a second storage capacitor 32 are provided. The second photodiode 30 is connected between the gate of the drive transistor 22 and one terminal of the second storage capacitor 32, and the discharge photodiode 27 is connected between that one terminal and the power supply line 26. The input to the pixel is supplied by the address transistor 16 to the other terminal of the second storage capacitor 32.

As will be apparent from the following, the second storage capacitor 32 is used for charge pumping. In particular, at the end of a frame period, the voltage on the gate of the drive transistor 22 is the threshold voltage, because this is the voltage at which the drive transistor 22 turns off. Furthermore, the second storage capacitor 32 is uncharged as charge is removed from it at the end of the address phase. The drive voltage is added by charge pumping to the threshold voltage already stored on the first storage capacitor 24.

At the beginning of an addressing phase, the NMOS address transistor 16 is turned on by a high pulse on the row conductor 4. A second transistor 34 (functioning as an isolating device) is provided between the drive transistor 22 and the display element 2, and this is a PMOS device. Thus, the high addressing pulse on the row conductor 4 turns on the address transistor 16 and simultaneously turns off the transistor 34 so that the EL display element 2 is switched off during the addressing phase.

The pixel drive voltage on the column conductor 6 is low with respect to the power supply line voltage 26, so that when the drive voltage is applied, the second photodiode 30 is forward biased and current flows through it, sourced from the capacitor 24 which had a voltage drop of only the drive transistor threshold voltage. This current charges the second capacitor 32 until an equilibrium is reached, and at this point, the voltage across the storage capacitor 24 has a value dependent on the initial threshold voltage and on the pixel drive voltage applied to the column 6, and additionally dependent on the ratios of the capacitances of 24 and 32.

If the capacitance of the storage capacitor 24 is much greater than the capacitance of the second capacitor 32 ($C_{24} >> C_{32}$), then the final voltage across the storage capacitance is approximately equal to the threshold voltage $V_T$ plus a factor ($C_{32}/C_{24}$) of the drive voltage. This requires large voltage swings for the drive voltage, as the drive voltage is reduced by the $C_{32}/C_{24}$ factor.

During the addressing phase, the second transistor 34 is turned off, so that there is no illumination of the photodiodes 27, 30 and no significant additional minority carrier currents flow in the photodiodes. The photodiodes are screened from external illumination.

At the end of the addressing phase, the column 6 is driven to a high voltage so that the photodiode 27 is forward biased and the charge on the second capacitor 32 is removed, but the charge on the first storage capacitor 24 is left unchanged. At the end of the addressing phase, the addressing transistor 16 is turned off and the second transistor 34 is turned on, and the pair of photodiodes 27, 30 act to decay the charge on the storage capacitor 24 until the threshold voltage is reached and the drive transistor 22 is turned off.

The initial voltage on the storage capacitor at the end of the addressing phase is now:

$$V(0)=f_1(V_{data})+f_2(V_T)$$

Where f1 and f2 are functions dependent on the relative capacitances of capacitors 24 and 32 and $V_{data}$ is the voltage applied to the column conductor 6. As mentioned above, $f_2$ can be made to approximate to 1by suitable selection of the capacitances. By ensuring the voltage on the storage capacitor is increased in dependence on the drive voltage, rather than charged to the drive voltage, the dependency on the threshold voltage can be removed. In particular, the integrated light output of equation [1] becomes:

$$L_T = \frac{C_S}{\eta_{PD}} f(V_{DATA}) \quad [2]$$

As mentioned above, this embodiment requires large voltage swings in $V_{data}$, and further embodiments below avoid this requirement.

Figure 5:
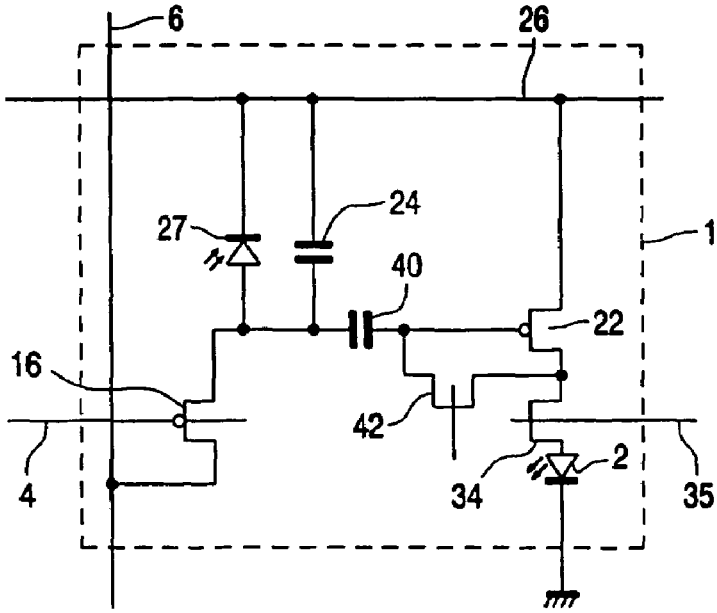
FIG. 5 shows a second example of pixel circuit according to the invention.

FIG. 5 shows a second embodiment, in which the storage capacitor 24 and the discharge photodiode 27 are connected in parallel between the power supply line 26 and an input to the pixel (namely the output of the address transistor 16).

The circuit has a threshold storage capacitor 40 connected between the input and the gate of the drive transistor 22. In this arrangement, the storage capacitor 24 does not store the desired source-gate voltage of the drive transistor 22. Instead, the storage capacitor 24 stores the input drive voltage, and the series-connected threshold storage capacitor 40 provides a voltage shift between the storage capacitor and the gate of the drive transistor 22.

In order to provide the threshold voltage across threshold storage capacitor 40, a bypass transistor 42 is connected between the source and gate of the drive transistor for charging the threshold storage capacitor 40 to the threshold voltage using a current of the drive transistor. As in the example of FIG. 4, an additional isolating transistor 34 is provided between the drive transistor 22 and the display element 2, and provided with its own address line 35.

During the addressing phase for this circuit, the addressing transistor 16 is initially turned on to store a constant initial voltage on the storage capacitor 24. This constant voltage is the power supply line voltage so that capacitor 24 is discharged and the photodiode 27 is shorted. The address transistor 16 can then be turned off. The isolating transistor 34 is turned on (or it may have been on since the beginning of the address phase), so that a current is driven through the EL display element. An ON-current thus passes through the drive transistor 22. The bypass transistor 42 is then turned on, and the isolating transistor is turned off. The drive transistor 22 remains on, as the gate-source voltage has not changed, but the drive current of the drive transistor 22 passes through the bypass transistor 42 to the threshold storage capacitor 40.

When sufficient charge has passed to the threshold storage capacitor 40, the voltage on the terminal connected to the drive transistor gate reaches a level when the PMOS drive transistor turns off. At this point, the threshold voltage of the drive transistor 22 is stored on the threshold storage capacitor 40.

The bypass transistor 42 is then turned off and the storage capacitor 24 is charged to the desired data voltage, by applying the data voltage to the column 6 and switching on the address transistor 16.

The photodiode action thus only takes place when the second transistor 34 is turned on at the end of the address sequence, and the threshold storage capacitor 40 introduces a step voltage change between the voltage on the storage capacitor 24 and the voltage applied to the gate of the drive transistor 24. Again, by ensuring the voltage applied to the gate is increased relative to the source (namely decreased in absolute terms) by the threshold voltage, the dependency on the threshold voltage is removed.

Figure 6:
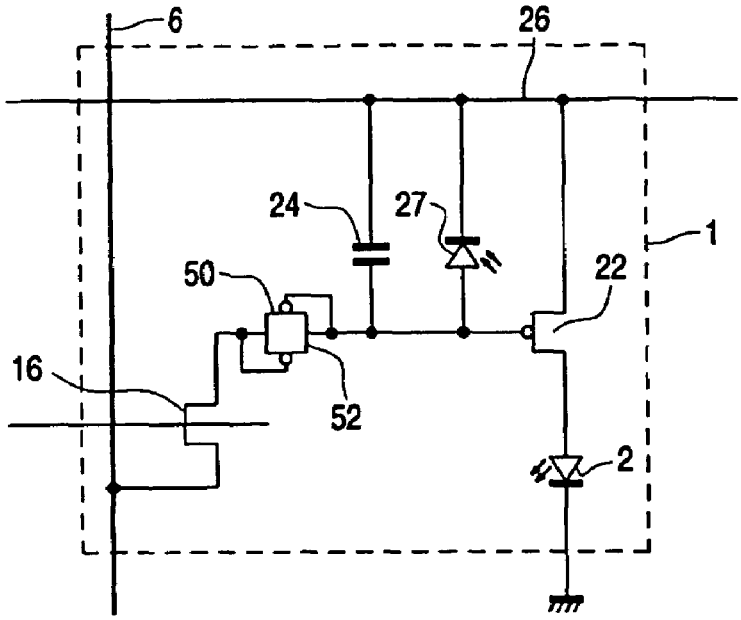
FIG. 6 shows a third example of pixel circuit according to the invention.

FIG. 6 shows a third embodiment in which the storage capacitor 24 and photodiode 27 are again connected between the power supply line 26 and the gate of the drive transistor 22. Two parallel oppositely facing diode-connected transistors 50, 52 are connected between the input to the pixel (the output of the address transistor 16) and the gate of the drive transistor 22. One of the diode-connected transistors provides a voltage drop of the threshold voltage and to provide this the diode-connected transistor is matched to the drive transistor 22. This voltage drop between the voltage input to the pixel and the voltage stored on the storage capacitor 24 results in an increase of the gate-source voltage on the drive transistor 22 by the same amount. This again removes the dependency of the light output on the threshold voltage.

The second diode-connected transistor is required for the resetting of the pixel.

The above pixel designs show some possible implementations of voltage-addressed pixels having aging compensation implemented using photodiode optical feedback circuits and with threshold compensation implemented in various ways.

Figure 7:
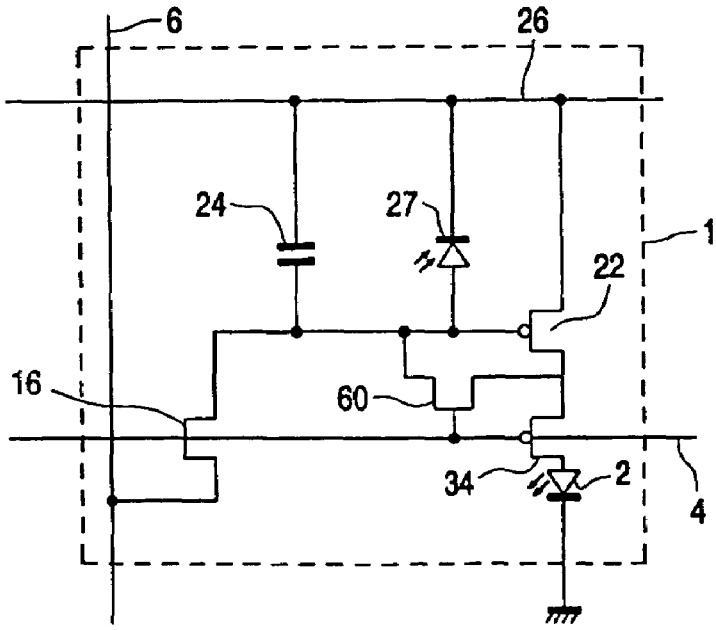
FIG. 7 shows a fourth example of pixel circuit according to the invention.

The invention can also provide current-addressed implementations. FIG. 7 shows an arrangement in which a current sampling circuit is used to sample a drive current. This enables threshold voltage variations to be avoided. The photodiode additionally enables aging compensation to be implemented.

In FIG. 7, the current sampling circuit comprises the additional transistor 34 for selectively isolating the drive transistor 22 from the display element 2 and a bypass transistor 60 for selectively connecting the drive transistor 22 to the input of the pixel (again this input is taken to be the output of the address transistor 16).

To sample an input current, the bypass transistor 60 is turned on and the additional transistor 34 is turned off. The input current is thus driven through the drive transistor 22. The storage capacitor is charged to the corresponding gate-source voltage of the drive transistor 22, and subsequently drives the drive transistor 22. This current sampling circuit uses the drive transistor for the current sampling, and the sampling operation takes into account the transistor characteristics, so that threshold variations are avoided.

Other circuits are also possible which act as current mirrors, with separate current sampling and current drive transistors—these do, however, require matched transistor characteristics.

The voltage addressed circuits described above all operate by modifying the drive voltage by an amount corresponding to the threshold voltage of the drive transistor. This modified drive voltage is stored in one or more capacitors and applied to the gate of the drive transistor, thereby compensating for threshold variations between drive transistors of different pixels. In addition, capacitor discharge using a photodiode illuminated by the light output of the electroluminescent display element compensates for aging variations between pixels. The circuits above are only examples of possible circuits for this purpose, and other implementations will be apparent to those skilled in the art.

The current addressed circuit described above samples an input drive current to obtain a gate-source voltage of the drive transistor corresponding to the drive current. This gate-source voltage is stored and applied to the drive transistor. Again, capacitor discharge using a photodiode illuminated by the light output of the electroluminescent display element compensates for aging variations between pixels. The circuit above is only one example of a possible current-addressed implementation and other implementations will be apparent to those skilled in the art.

The specific examples above also use different combinations of NMOS and PMOS transistors, and it will be understood that other specific implementations will be apparent.

The invention claimed is:

1. An active matrix electroluminescent display device comprising an array of display pixels, each pixel comprising:

an electroluminescent display element (2);

a drive transistor (22) connected between a power supply line (26) and the display element (2) for driving a current through the display element (2);

a storage capacitor (24) for storing a voltage to be used for addressing the drive transistor;

a discharge photodiode (27) for discharging the storage capacitor (24) in dependence on the light output of the display element; and circuit elements for changing an input data voltage applied to the pixel by an amount corresponding to the threshold voltage of the drive transistor, and for applying the changed data voltage between the gate and the source of the drive transistor (22), wherein the circuit elements comprise a second photodiode (30) and a second storage capacitor (32),.wherein the second photodiode (30) is connected between the gate of the drive transistor (22) and one terminal of the second storage capacitor (32), and the discharge photodiode (27) is connected between the one terminal and the power supply line (26).

2. A device as claimed in claim 1, wherein each pixel further comprises an address transistor (16) connected between a data signal line (6) and an input to the pixel.

3. A device as claimed in claim 1, wherein the storage capacitor (24) is connected between the power supply line (26) and the gate of the drive transistor.

4. A device as claimed in claim 1,wherein data input to the pixel is supplied to the other second terminal of the second storage capacitor (32).

5. A device as claimed in claim 1,wherein the circuit elements further comprise an isolating transistor (34) connected between the drive transistor (22) and the display element (2).

6. A device as claimed in claim 3, wherein the photodiode (27) is connected between the power supply line (26) and the gate of the drive transistor (22), and the circuit elements comprise two parallel oppositely facing diode-connected transistors (50, 52) connected between the input to the pixel and the gate of the drive transistor (22).

7. A device as claimed in claim 1,wherein the storage capacitor (24) and the discharge photodiode (27) are connected in parallel between the power supply line (26) and an input to the pixel, and the circuit elements comprise a threshold storage capacitor (40) connected between the input and the gate of the drive transistor.

8. A device as claimed in claim 7, wherein the circuit elements further comprise a bypass transistor (42) connected between the source and gate of the drive transistor (22) for charging the threshold storage capacitor (40) to the threshold voltage using a current of the drive transistor (22).

9. An active matrix electroluminescent display device comprising an array of display pixels, each pixel comprising:

an electroluminescent display element (2);

a current sampling circuit for sampling a drive current and including a drive transistor (22) for driving current through the display element;

a storage capacitor (24) for storing a gate-source voltage for the drive transistor (22) corresponding to the sampled drive current;

a photodiode (27) for discharging the storage capacitor (24) in dependence on the light output of the display element and circuit elements for changing an input data voltage applied to the pixel by an amount corresponding to the threshold voltage of the drive transistor, and for applying the changed data voltage between the gate and the source of the drive transistor (22), wherein the circuit elements comprise a second photodiode (30) and a second storage capacitor (32), wherein the second photodiode (30) is connected between the gate of the drive transistor (22) and one terminal of the second storage capacitor (32). and the discharge photodiode (27) is connected between the one terminal and the power supply line (26).

10. A device as claimed in claim 9, wherein the current sampling circuit comprises an isolating transistor (34) for selectively isolating the drive transistor (22) from the display element (2) and a bypass transistor (60) for selectively connecting the drive transistor (22) to the input of the pixel.

11. A method of driving an active matrix electroluminescent display device comprising an array of display pixels each comprising a drive transistor (22) and an electroluminescent display element (2), the method comprising, for each addressing of the pixel:

applying a drive voltage to an input of the pixel;

modifying the drive voltage by an amount corresponding to the threshold voltage of the drive transistor (22);

storing the modified drive voltage in a capacitor arrangement and storing the modified drive voltage to the gate of the drive transistor, thereby compensating for threshold variations between drive transistors of different pixels; and discharge the capacitor arragement using a photodiode(27) illuminated by the light output of the electroluminescent display element, thereby compensating for aging variations between pixels, wherein strong the modified drive voltage comprises strong the drive voltage on a first capacitor (24) and storing a voltage cerresponding to the threshold voltage of the drive transistor on a seccond capacitor (40).

12. A method as claimed in claim 11, wherein storing the modified drive voltage further comprises pumping the drive voltage onto a storage capacitor (24) on which a voltage corresponding to the threshold voltage was previously provided.

13. A method of driving an active matrix electroluminescent display device comprising an array of display pixels each comprising a drive transistor (22) and an electroluminescent display element (2), the method comprising, for each addressing of the pixel:

applying a drive current to an input of the pixel;

sampling the drive current to obtain a gate-source voltage of the drive transistor corresponding to the drive current;

storing the gate-source voltage on a storage capacitor (24);

applying the gate-source voltage to the drive transistor; and discharging the storage capacitor using a photodiode illuminated by the light output of the electroluminescent display element, wherein storing the gate-source voltage comprises storing the gate-source voltage on a first capacitor (24) and storing a voltage corresponding to the threshold voltage of the drive transistor on a second capacitor (40).

* * * * *